United States Patent [19]

Miyake et al.

[11] 3,977,037

[45] Aug. 31, 1976

[54] VACUUM CLEANER

[75] Inventors: Yuji Miyake, Himeji; Hideo Kashihara, Kasai; Kazuyoshi Takahashi, Hyogo; Takamitu Yamamoto; Takuya Morishita, both of Kasai, all of Japan

[73] Assignee: Sanyo Electric Co., Ltd., Japan

[22] Filed: Sept. 19, 1974

[21] Appl. No.: 507,590

[30] Foreign Application Priority Data

| | | |
|---|---|---|
| Oct. 15, 1973 | Japan | 48-119533[U] |
| Oct. 16, 1973 | Japan | 48-120548[U] |
| June 11, 1974 | Japan | 49-68272[U] |

[52] U.S. Cl. ..... 15/315; 15/323; 15/352; 226/181; 254/175.5

[51] Int. Cl.[2] ..... A47L 9/00

[58] Field of Search ..... 15/315, 323, 347, 352, 15/336, 327 F; 226/118, 181; 254/175.5

[56] References Cited

UNITED STATES PATENTS

| | | | |
|---|---|---|---|
| 2,051,728 | 8/1936 | Manning | 15/315 |
| 2,670,926 | 3/1954 | Sewell et al. | 254/175.5 |
| 3,009,188 | 11/1961 | Martin | 15/352 X |
| 3,200,432 | 8/1965 | Voegeli et al. | 15/327 F X |
| 3,619,851 | 11/1971 | Bolzan, Jr. et al. | 15/315 X |

FOREIGN PATENTS OR APPLICATIONS

| | | | |
|---|---|---|---|
| 271,092 | 1/1951 | Switzerland | 15/315 |

*Primary Examiner*—Billy J. Wilhite
*Assistant Examiner*—C.K. Moore
*Attorney, Agent, or Firm*—Armstrong, Nikaido & Wegner

[57] ABSTRACT

A vacuum cleaner of a baseboard type which is concealed in a handsome article of furniture so that the vacuum cleaner concurrently serves as a piece of furniture. To this end, the vacuum cleaner herein disclosed comprises a housing structure of a substantially hollow cubic body having a first chamber adapted to accommodate therein a length of a flexible vacuum hose, a second chamber in which a source of vacuum is housed and a third chamber adapted to removably accommodate a dust collector. A lid is provided at either or both of the top and side of the housing structure and may provide for the convenient storage of some appurtenances such as floor brush, extensible wand, nozzle, etc. An automatic drawing mechanism for drawing a length of the flexible vacuum hose, that has been taken out of the hose chamber for use, back into the hose chamber is also provided.

17 Claims, 17 Drawing Figures

VACUUM CLEANER

Figure 1:
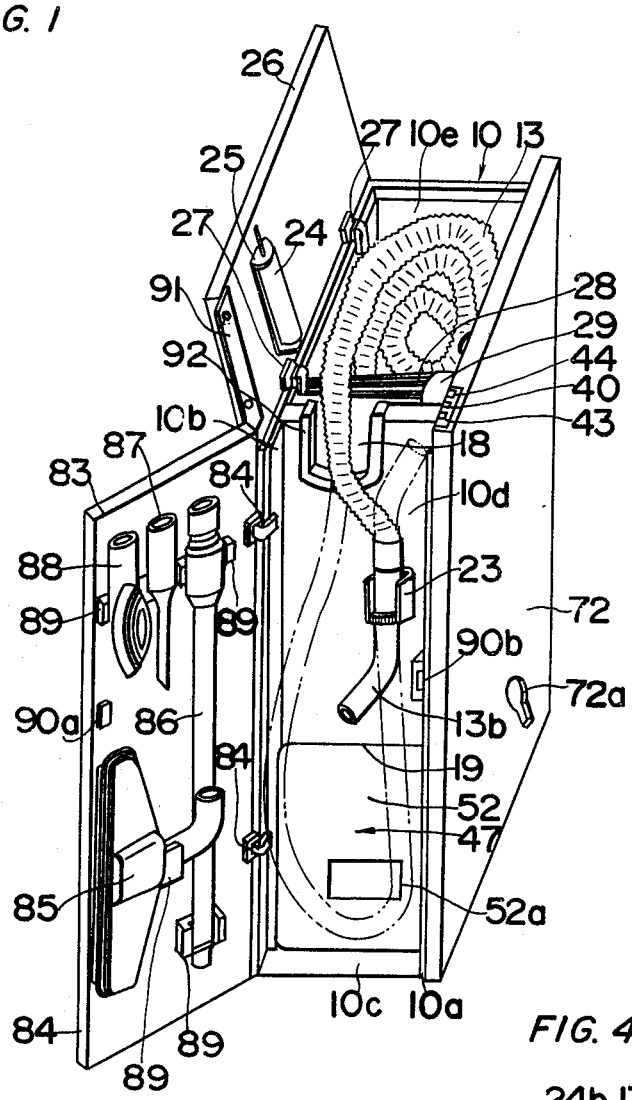

The present invention relates to a vacuum cleaner and, more particularly, to a vacuum cleaner concealed in a handsome article of furniture so that the vacuum cleaner serves as a piece of furniture.

A certain type of vacuum cleaner, which has heretofore largely employed in the home, requires a storeroom in which it is temporarily stored when not in use. This is because it often constitutes something offensive to look at if left in a room, for example, a living room. In order to avoid this inconvenience, vacuum cleaners well ordered in form or appearance have recently been developed and some of them are now commercially available. By way of example, so far as a machine of this kind which also serves as a piece of furniture is concerned, various hassock type vacuum cleaners or combined vacuum cleaner and hassock units are known.

Although the hassock type vacuum cleaners are convenient and handsome-looking, because of the nature and limited size of the hassock, a space available is limited and, therefore, a vacuum hose has, before and after cleaning operation, to be respectively connected to and disconnected from a suction socket leading to a source of vacuum. In addition, by the same reason, the length of the vacuum hose which can be accommodated in the hassock type vacuum cleaner of a conventional type is limited and, therefore, the combined hassock and cleaner unit has to be moved from place to place in order that corner-to-corner cleaning in a room of a reasonable floor space can be achieved.

Accordingly, an essential object of the present invention is to provide a vacuum cleaner of a type comfortable to look at and which utilizes a length of vacuum hose sufficient to achieve the corner-to-corner cleaning in a room of a reasonable floor space without requiring the vacuum cleaner to be moved from place to place in the room to be cleaned, thereby substantially eliminating the disadvantages inherent in the conventional vacuum cleaners.

Another object of the present invention is to provide a vacuum cleaner of the type referred to above, wherein means is provided for automatically drawing the vacuum hose of a relatively great length into a hose chamber formed in the housing of the vacuum cleaner.

A further object of the present invention is to provide a vacuum cleaner of the type referred to above, which is capable of accommodating completely within the housing of the vacuum cleaner, all of the operating parts such as motor, filter, dust bag, etc., the vacuum hose and other appurtenances such as floor cleaning brush, cloth cleaning brush, extensible wand, elbow or bent pipe, etc., when the vacuum cleaner is not in use, thereby rendering the vacuum cleaner to represent a handsome-looking piece of furniture.

A still further object of the present invention is to provide a vacuum cleaner of the type referred to above, which does not substantially require a space for storage thereof and can, when left in a room, occupy a space not larger than that occupied by the conventional vacuum cleaner.

According to a preferred embodiment of the preferred embodiment of the present invention, the vacuum hose may not be connected to and disconnected from the suction socket leading to the source of vacuum through a dust collector substantially composed of a removable receptacle. This is because, while an inner end of the vacuum hose may be fixed in position to engage into the suction socket formed in the housing of the vacuum cleaner, the suction socket is automatically connected to the dust collector when and so long as the removable receptacle is placed in position within the housing of the vacuum cleaner.

In other preferred embodiments of the present invention, though connection and disconnection of the vacuum hose to and from the suction socket is required, it may not be carried out each time cleaning operation is to be performed, but each time a mass of dust collected in the dust collector is to be removed away.

In any of the embodiments herein disclosed, means for drawing back into the hose chamber within the housing of the vacuum cleaner, a certain or required length of the vacuum hose that has been pulled or removed out of the hose chamber for use in a cleaning job. This drawing means comprises a drive roll and a driven roll arranged in parallel relation to each other and spaced a distance substantially smaller than the outer diameter of the vacuum hose.

In addition thereto, all of the operating parts of the vacuum cleaner and its appurtenances are completely concealed within the housing structure of a cubic body.

Figure 6:
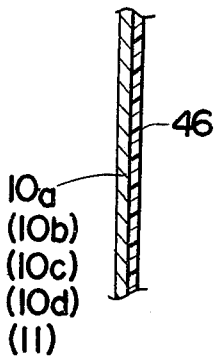
Figure 4:
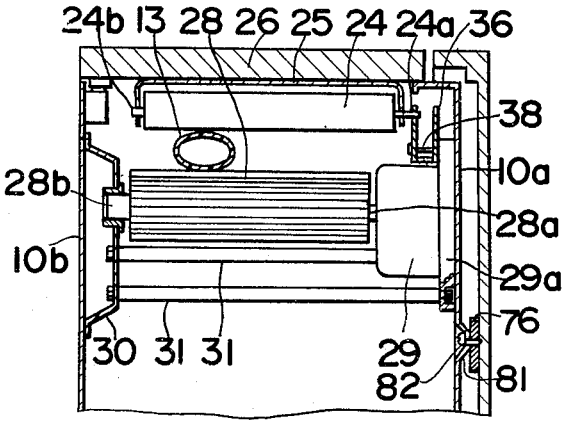
Figure 5:
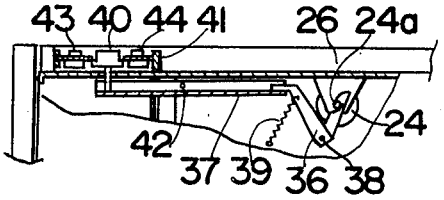
Figure 2:
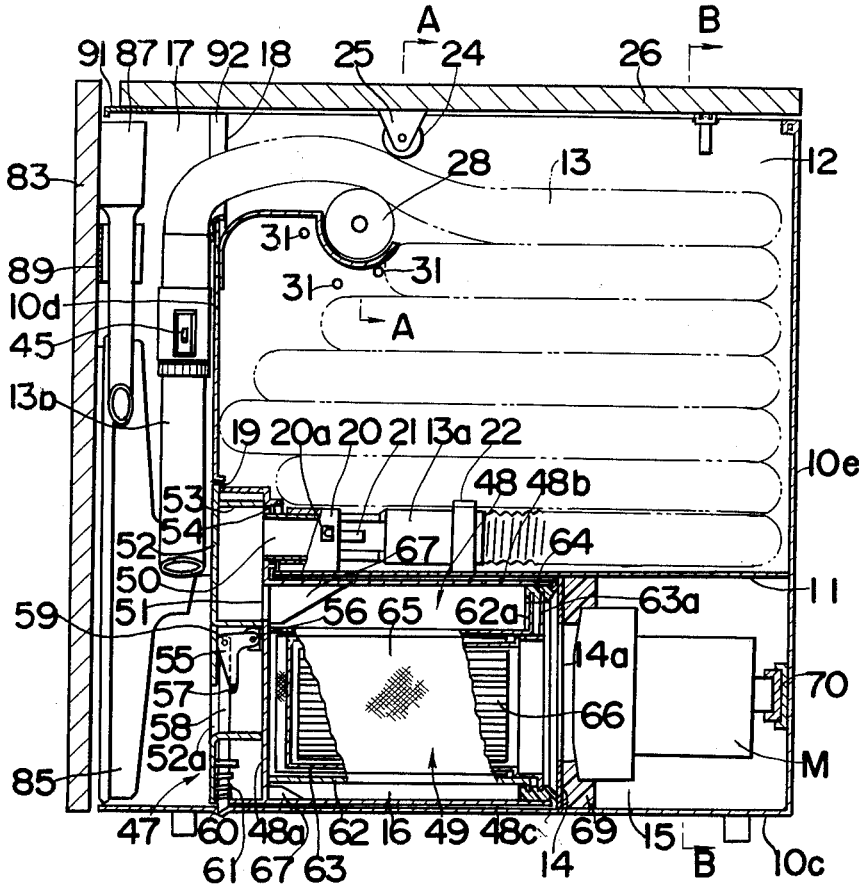
Figure 3:
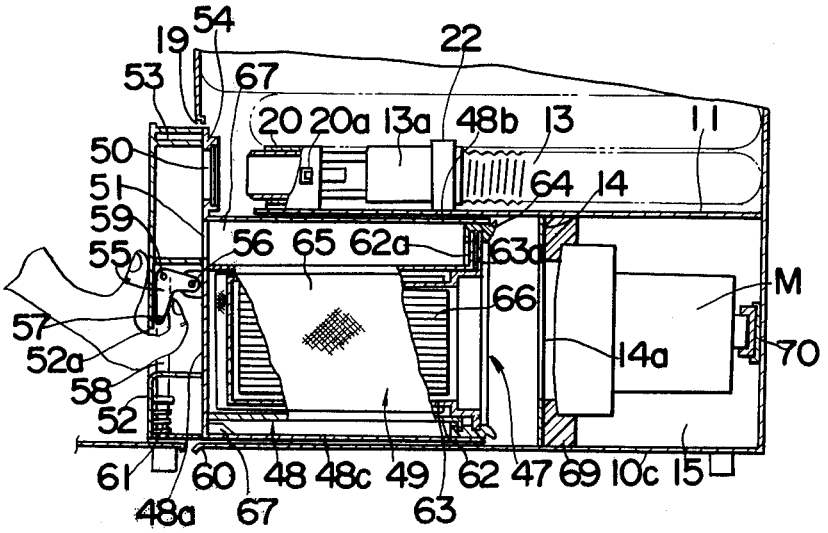
Figure 7:
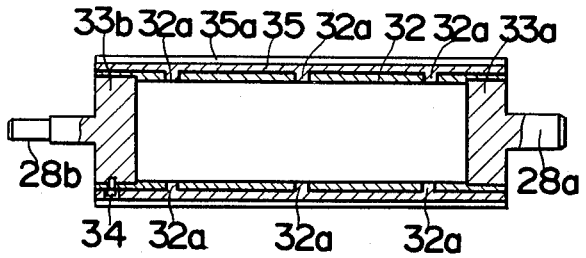
Figure 8:
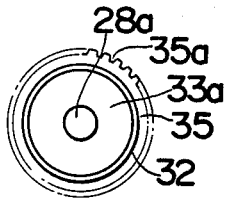
Figure 9:
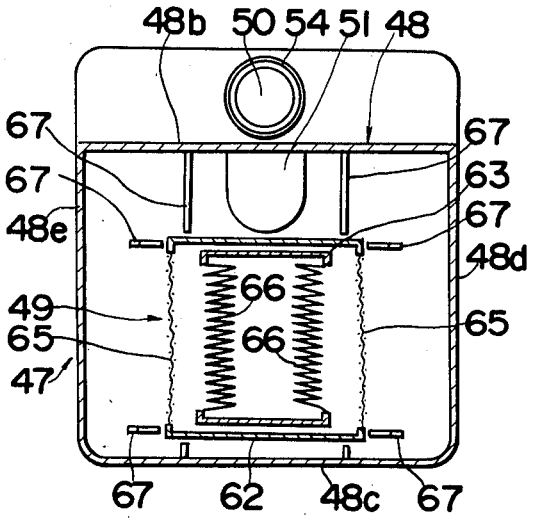
Figure 10:
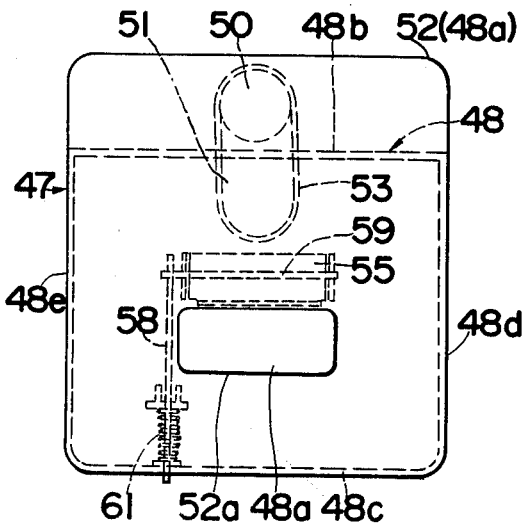
Figure 11:
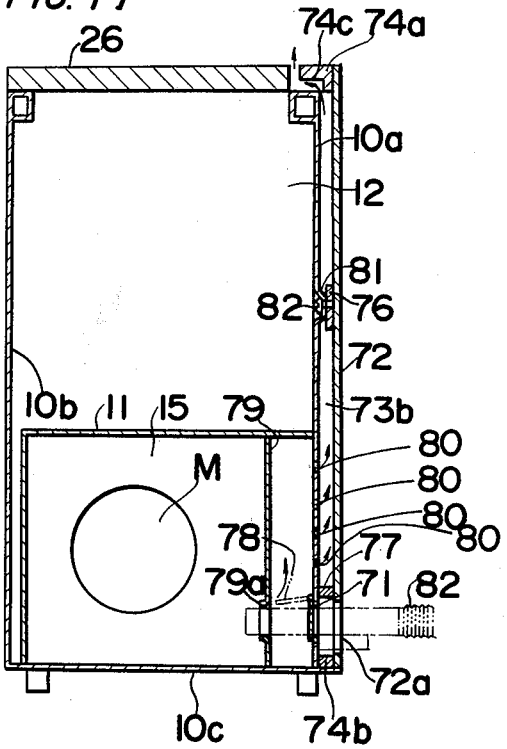

These and other objects and features of the present invention will become readily understood from the following description taken in conjunction with preferred embodiments thereof with reference to the accompanying drawings, in which:

FIG. 1 is a perspective view of a vacuum cleaner according to a preferred embodiment of the present invention, with top and side lids opened, FIG. 2 is a front sectional view of the vacuum cleaner shown in FIG. 1, with the top and side lids closed, FIG. 3 is a view similar to FIG. 2, showing a lower portion of the vacuum cleaner with a dust collector being in process to be removed away from the body of the vacuum cleaner, FIG. 4 is a cross-sectional view taken along the line A—A in FIG. 2, FIG. 5 is a sectional view showing a locking device for locking the top lid in the closed position, FIG. 6 is a sectional view of a portion of walls defining the hose chamber, FIG. 7 is a longitudinal sectional view of a drive roll employed in the vacuum cleaner for drawing the vacuum hose back into the hose chamber, FIG. 8 is an end view of FIG. 7, FIG. 9 is a front sectional view of the dust collector employed in the vacuum cleaner of FIG. 1, FIG. 10 is a front elevational view of the dust collector employed in the vacuum cleaner of FIG. 1, FIG. 11 is a cross-sectional view taken along the line B—B in FIG. 2

Figure 12:
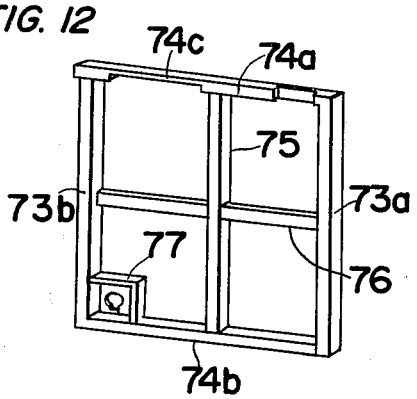
Figure 13:
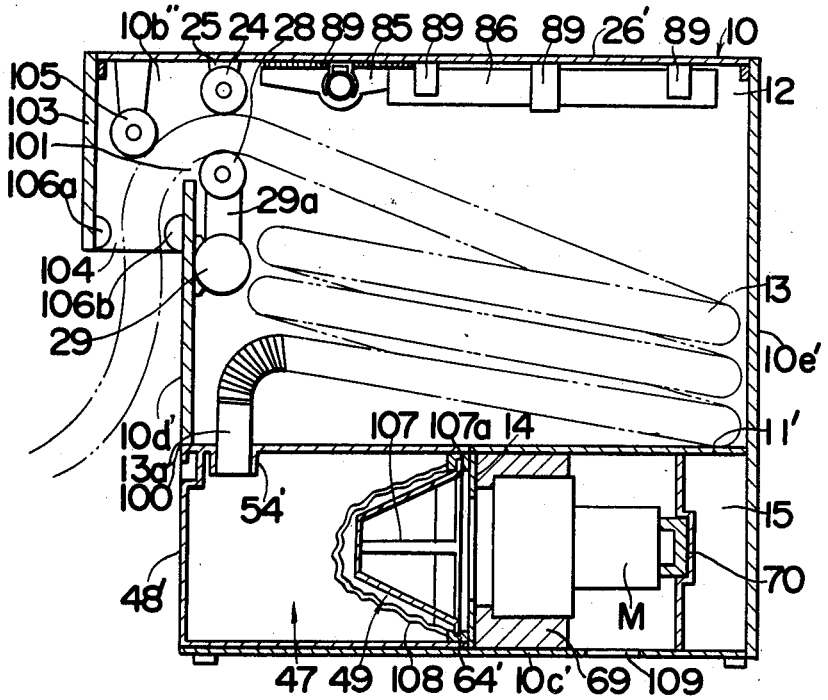
Figure 14:
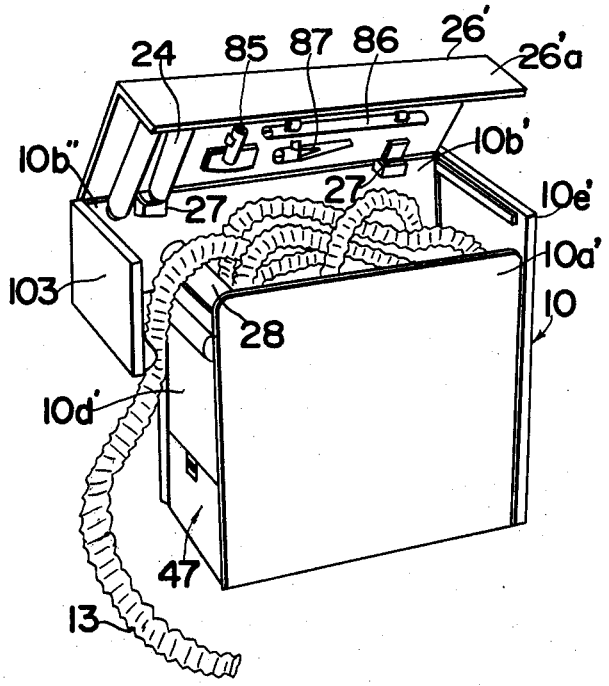
Figure 15:
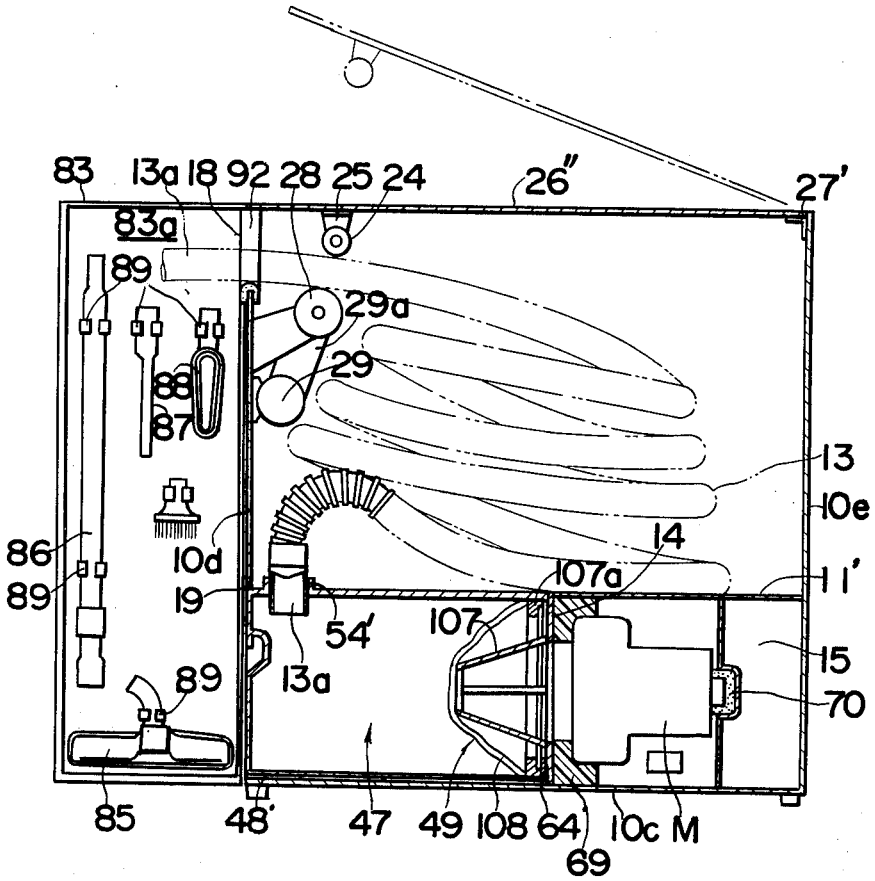
Figure 16:
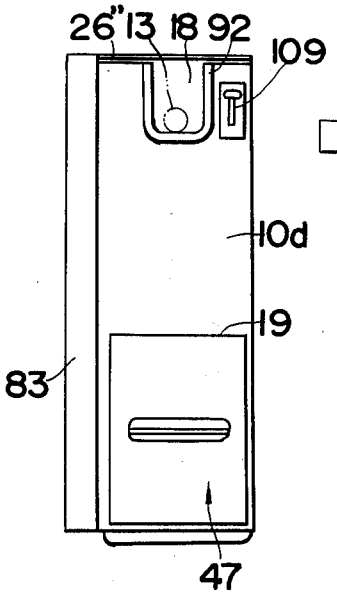
Figure 17:
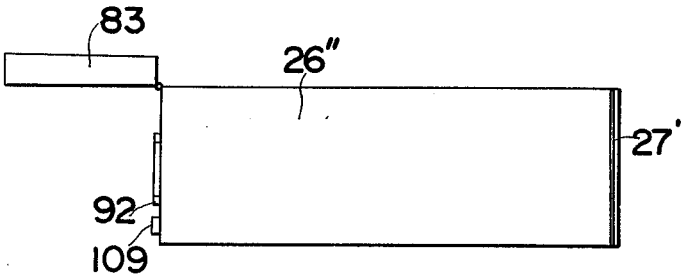

FIG. 12 is a perspective view, on a reduced scale, of a spacer structure through which a decorative siding panel is secured to the front wall of the housing, FIG. 13 is a view similar to FIG. 2, showing a vacuum cleaner according to another preferred embodiment of the present invention, FIG. 14 is a perspective view of the vacuum cleaner shown in FIG. 13, with a top lid opened, FIG. 15 is a view similar to FIG. 2, showing a vacuum cleaner according to a further preferred embodiment of the present invention, FIG. 16 is a front elevational view of the vacuum cleaner shown in FIG. 15, with a side lid opened, and FIG. 17 is a top plan view of FIG. 16.

Before the description of the present invention proceeds, it should be noted that like parts are designated by like reference numerals throughout the accompanying drawings. It is also to be noted that in the specification and the appended claims, the descriptive terms "front", "rear" and "side", for example, are merely relative and are used for clarity of description and are not to be interpreted in a limiting sense. For example, the rear of the vacuum cleaner may serve as the front of the cleaner if a decorative siding panel is attached thereto. Moreover, one of the opposed sides of the vacuum cleaner which is provided with a side lid as will be described later may serve as the front of the cleaner.

Referring first to FIGS. 1 to 12 in which the embodiment of the present invention is shown, the vacuum cleaner comprises a housing structure representing a cubic body and generally indicated by 10. This housing structure 10 has front, rear, bottom and opposed side walls which are respectively designated by 10*a*, 10*b*, 10*c*, 10*d* and 10*e*, and is, as best shown in FIG. 2, divided by a substantially horizontally extending partition plate 11 into an upper compartment which serves as a chamber 12 for accommodating a length of vacuum hose 13 in a substantially coiled configuration and a lower compartment which is sub-divided by a apertured partition wall 14 into a chamber 15 for accommodating an electric motor M and a chamber 16 for accommodating a dust collector of a construction as will be described later. It should be noted that one of the opposed side walls of the housing structure 10, which is designated by 10*d*, is situated inwardly of the housing structure 10 to provide a space 17, which functions as will be described later, and is formed with a substantially U-shaped opening 18 and a substantially rectangular entrance 19 communicating to the collector chamber 16. While the partition plate 11 has one end secured to the side wall 10*e* and the other end terminating adjacent the plane of the other side wall 10*d*, the height of the entrance 19 formed in the side wall 10*d* is greater than the height of the collector chamber 16 between the bottom all 10*c* and the partition plate 11.

The vacuum hose 13 is of a type made of a conventional flexible plastic tubing of spiral ribbed design, that is, reinforced by a piano wire spirally coiled within the flexible plastic tubing, and has both ends mounted with rigid, inner and outer terminals tubings 13*a* and 13*b*. As best shown in FIGS. 2 and 3, the inner terminal tubing 13*a* and a portion of the flexible vacuum hose 13 adjacent thereto rest above the partition plate 11 within the hose chamber 12 while a portion adjacent the free end extremity of the inner terminal tubing 13*a* is held in a definite position by a tubular bracket 20 rigidly secured in position above the partition plate 11. In order to achieve this, the inner terminal tubing 13*a* and the tubular bracket 20 may have a lock which may, so far as the illustrated embodiment is concerned, comprises a radially outwardly biased elastic finger member 21, secured to or integral with the inner terminal tubing 13*a*, and a detent hole 20*a* formed in the bracket 20 and into which the free end of the elastic finger member 21 is trapped as the terminal tubing 13*a* is inserted through the bracket 20. Separation of the terminal tubing 13*a* from the bracket 20 can be carried out by depressing the elastic finger member 21 against its own resiliency so as to disengage the free end thereof from the detent hole 20*a*. Whatever the type of the lock, it should be noted that the arrangement involved is designed such as to permit the free end extremity of the inner terminal tubing 13*a*, when held in the definite position, to project a predetermined distance through the bracket 20 as clearly shown in FIG. 3, so that the plane of the end extremity of the inner terminal tubing 13*a* lies on the same plane as the opening of the collector chamber 16. Preferably, in order to secure the inner terminal tubing 13*a* in a more reliable manner, a ring mount 22 is rigidly mounted on the partition plate 11 for supporting the vacuum hose 13 in position in such a manner that the terminal tubing 13*b* extends therethrough.

So far as shown in FIG. 2, the outer terminal tubing 13*b* and the outer end portion of the vacuum hose 13 adjacent thereto project outwardly of the hose chamber 12 through the U-shaped opening 18 in the side wall 10*d* with the terminal tubing 13*b* detachably secured or supported by an elastic clip 23, which clip 23 is rigidly secured to the side wall 10*d* facing the space 17. In order that the vacuum hose 13 that has been pulled or removed out of the hose chamber 12 in a manner as will be described later for use in cleaning, for example, a room, can automatically be drawn back into the hose chamber 12, an automatic drawing mechanism is providing which will now be described with particular reference to FIGS. 1, 2, 4, 7 and 8.

The automatic drawing mechanism comprises a driven roll 24 rotatably supported through a bracket 25 by and beneath a top lid 26, which is hinged as at 27 to the top edge of the rear wall 10*b* for selective opening and closing the top opening of the housing structure 10, and a drive roll 28 which horizontally extends between the front and rear walls 10*a* and 10*b* and is supported in such a manner as best shown in FIG. 4.

The drive roll 28 has a pair of shaft members 28*a* and 28*b* projecting outwards from respective ends of said drive roll 28. The shaft member 28*a* is coupled to an electric motor 29 of a type having a built-in reduction gear, which motor 29 is rigidly secured to the inner surface of the front wall 10*a* through a rigid base 29*a* forming a part of a housing for the motor 29. On the other hand, the shaft member 28*b* is rotatably journalled to a substantially dish-shaped bearing plate 30 rigidly secured to the inner surface of the rear wall 10*b* in spaced relation to said wall 10*b*. Extending between the rigid base 29*a* and the bearing plate 30 in parallel relation to the drive roll 28 is a plurality of beam members 31 each having both ends bolted to the base 29*a* and the bearing plate 30, which beam members 31 provide a rigid framework for the drive roll 28 together with the base 29*a* and the bearing plate 30. When the drive roll 28 and the motor 29 are to be installed in a definite position within the housing structure 10, it is preferred that the drive roll 28, the motor 29, the bearing plate 30 and the beam members 31 should be assembled prior to the installation so that no complicated mounting procedure is required.

It should be noted that the assembly including the drive roll 28, the motor 29, the bearing plate 30 and the beam members 31 also serves as a spacer means for holding the front and rear walls 10*a* and 10*b* of the housing structure 10 in spaced relation to each other at an upper portion of the hose chamber 12. It is also to be noted that the automatic drawing mechanism of the above construction is situated within the hose chamber 12 and adjacent one of the upper corners of said chamber 12 which is close to the U-shaped opening 18 in the side wall 10*d*.

In order that the once-used vacuum hose 13 can reliably and effectively be drawn back into the hose chamber 12, the relative position of the drive and driven rolls 28 and 24 should be selected such that the vacuum hose 13 being drawn through a gap between these rolls is slightly deformed to represent a substantially egg-like shape as shown in FIG. 4. This requirement will not be satisfied even though the rolls 24 and 28 and their associated parts are accurately dimensioned and positioned relative to each other, unless the top lid 26 can otherwise be locked in a closed position. For this purpose a lid locking mechanism is provided as will be described later.

In addition, a countermeasure should be taken to avoid any possible slippage which may occur between the vacuum hose 13 being drawn and the drive roll 28. To this end, in the case where the vacuum hose 13 is of a spiral ribbed design as is the case of the illustrated embodiment, the drive roll 28 is preferably constructed as best shown in FIGS. 7 and 8. So far illustrated, the drive roll 28 comprises a hollow cylindrical body 32, made of a rigid material such as metal, having both ends closed by respective blocks 33*a* and 33*b* by any suitable method, for example, by a pressure fitting technique or by the use of a plurality of set screws, only one of which screws is shown by 34. The blocks 33*a* and 33*b* are respectively integrally formed with the shaft members 28*a* and 28*b*, the function of each of these shaft member 28*a* and 28*b* having already been described earlier. However, it is to be noted that, although not shown, the shaft member 28*a* is rigidly mounted with a gear or is formed into a gear shaft for operative connection with the motor 29.

On the outer peripheral surface of the cylindrical body 32, an elastic layer 35, made of any suitable material having a relatively high frictional coefficient, such as polyurethane, is applied or coated. Preferably, while the cylindrical body 32 is perforated as at 32*a*, the elastic layer 35 is made in part to penetrate through the perforations 32*a* during application or coating thereof on the outer peripheral surface of the cylindrical body 32 so that a rigid and reliable interlocking between the elastic layer 35 and the cylindrical body 32 can be achieved.

The cylindrically shaped elastic layer 35 applied on the outer peripheral surface of the cylindrical body 32 is axially splined to provide a series of radially inwardly recessed grooves 35*a* spaced from each other at intervals of a pitch substantially equal to the span between the adjacent pair of convolutions of the spiral rib of the vacuum hose 13, so that the vacuum hose 13 and the drive roll 28 can, during the drawing operation, engage to each other in a similar fashion to a gear-to-gear engagement, thereby completely eliminating any possible slippage which may otherwise occur therebetween.

In the case where the vacuum hose 13 is of a type having a smooth outer peripheral surface, the grooves 35*a* may not be provided on the elastic layer 35.

The lid locking mechanism will now be described in detail with particular reference to FIGS. 1, 4 and 5. As clearly shown in FIG. 4, the driven roll 24 has a pair of shaft members 24*a* and 24*b* axially outwardly extending from respective ends of said roll 24 in alignment with each other and also with the longitudinal axis of said roll 24. The shaft member 24*a* is longer than the shaft member 24*b* and, while the shaft member 24*b* is journalled to one arm of the bracket 25 secured to the inner surface of the lid 26, the shaft member 24*a* rotatably extends through the opposite arm of the bracket 25 and terminating substantially adjacent a part of the lid locking mechanism.

The lid locking mechanism comprises a latch lever 36 having one end recessed for engagement with the shaft member 24*a* and the other end operatively connected to a seesaw lever, a substantially intermediate portion of which latch lever 36 is pivotally mounted on a support pin 38 inwardly extending from the front wall 10*a* in parallel relation to the shaft member 24*a*. It should be noted that as best shown in FIG. 4 in relation to FIG. 2, the latch lever 36 is prepared by bending a metallic strip in a form similar to a bell crank.

The latch lever 36 is biased about the support pin 38 in one direction by an elastic element, for example, a tension spring 39 so that the recessed end of said lever 36 is constantly brought into position ready to receive the shaft member 24*a* while the other end of said lever 36 constantly engages the seesaw lever 37.

The lid locking mechanism so far described operates in such a manner that, when the top lid 26 is moved from the opened position as shown in FIG. 1 to the closed position as shown in FIGS. 4 and 5, the shaft member 24*a* is trapped by the recessed end of said latch lever 36, pivoting the latter against the tension spring 39 as it slides over the rounded end extremity of said recessed end of said latch lever 36, whereby the top lid 26 can be locked in the closed position. Disengagement between the shaft member 24*a* and the recessed end of the latch lever 36 for enabling the top lid 26 to be opened by hand can be achieved if the latch lever 36 is forcibly pivoted against the tension spring 39 by the application of an external pushing force.

For applying the external pushing force to the latch lever 36 so as to pivot the latter against the tension spring 39, the lid locking mechanism further comprises a lock release button 40 having one end formed into a button head which is exposed to the outside through a mounting panel 41 rigidly mounted on the upper edge of the front wall 10*a* at a position substantially above the motor 29. The other end of the lock release button 40 downwardly extends and terminates in contact with the seesaw lever 37, a substantially intermediate portion of which seesaw lever 37 is pivotally connected to the inner surface of the front wall 10*a* by a support pin 42. It should be noted that the seesaw lever 37 is also biased in one direction about the support pin 42 by a pulling force of the tension spring 39 which is transmitted thereto through the engagement between the other end of the latch lever 36 opposite to the recessed end thereof and one end of said seesaw lever 37 adjacent said other end of said latch lever 36, whereby the release button 40 is upwardly elevated.

Referring still to FIG. 5, it will be readily seen that depression of the button 40 causes the seesaw lever 37 to pivot in a counterclockwise direction about the support pin 42 against the tension spring 39 and, therefore, the latch lever 36 is also pivoted in a clockwise direction about the support pin 38 with the recessed end thereof disengaging from the shaft member 24*a* in readiness for the opening of the top lid 26.

While the lid locking mechanism is constructed as hereinbefore described, though the support pin 38 has been described as secured to the front wall 10*a*, it may not be always limited thereto, but be preferably bolted or screwed to the base 29*a*, which forms a part of the housing for the motor 29, to ensure a rigid and durable mounting of the support pin 38.

The mounting panel 41 so far illustrated is provided, in addition to the lock release button 40, with a pair of push-button type switches 43 and 44 on both sides of the button head of said release button 40. The switch 43 is electrically inserted in an electric circuit for the motor 29 while the switch 44 is electrically inserted in an electric circuit for the motor M. It should be understood that operation of the motor M forming the source of vacuum can be controlled not only by the switch 44, but also a switch 45 built in the outer terminal tubing 13*b* as shown in FIG. 2. The employment of the switch 45 in the outer terminal tubing 13*b* is of a known design practice such as disclosed in the U.S. Pat. No. 2,958,894, patented on Nov. 8, 1960.

As hereinbefore described, the vacuum hose 13 that has been pulled or removed out of the hose chamber 12 can automatically drawn back into the hose chamber 12 by the automatic drawing mechanism at any time, for example, after the cleaning operation has completed. At this time, the vacuum hose 13 being drawn back into the hose chamber 12 substantially spirally coiled within a limited space of the hose chamber 12. During the course of formation of the coiled configuration of the vacuum hose 13 being drawn back into the vacuum hose chamber 12, local portions of the vacuum hose 13 is, while it moves, rubbed in contact with portions of the inner surfaces of the respective walls 10*a*, 10*b*, 10*c* and 10*d* which define the hose chamber 12 together with the partition plate 11. This should be avoided, or otherwise portions of the outer layer of the vacuum hose 13 will be scratched off and spoiled accordingly. According to the present invention, in order to minimize friction between portions of the outer layer of the vacuum hose 13 and portions of the inner surfaces of the housing structure 10 which may lead to the above described spoilage of the vacuum hose 13, the inner surfaces of the walls 10*a*, 10*b*, 10*c* and 10*d* and partition plate 11 so far defining the hose chamber 12 are, as schematically and fragmentally shown in FIG. 16, applied with a low frictional layer 46 made of a material having a relatively low frictional coefficient. This layer 46 may be formed either by applying a painting solution containin silicon or fluorocarbon resin to the relevant surfaces of the housing structure 10 or by adhering to the relevant surfaces of the housing structure 10 a film or sheet which is made of nylon or polyethylane or which is coated with silicon or fluorocarbon resin.

Referring particularly to FIGS. 1, 2, 3, 9 and 10, the dust collector chamber 16 is adapted to removably accommodate a dust collector of a construction as will now be described. The dust collector generally indicated by 47 comprises a removable canister 48 of a hollow cubic body having front, top, bottom and opposed side walls 48*a*, 48*b*, 48*c*, 48*d* and 48*e* and having the rear end open towards the motor M, and a filter unit 49. It should be noted that the descriptive terms front, "top", "bottom" and side used in the description of the dust collector 47 and also in the appended claims so far as the dust collector construction is concerned are employed to designate specific positional relationships as viewed in a direction in which the dust collector 47 is selectively removed from and inserted into the dust collector chamber 16. It is also to be noted that the front wall 48*a* of the canister 48 is of a size greater than the cross sectional area of the body of the canister 48 defined by the top, bottom and side walls 48*b*, 48*c*, 48*d* and 48*e*, by a reason as will become understood from the subsequent description, and is formed therein with circular and substantially U-shaped openings as at 50 and 51, the latter opening 51 being in communication with an upper portion of the chamber 16 adjacent the top wall 48*b*.

The removable canister 48 includes a front panel 52 secured to the front wall 48*a* in spaced relation thereto, said front panel 52 being of a size substantially equal to the front wall 48*a* and of a size sufficient to enclose the entrance 19 in the side wall 10*d* of the housing structure 10. It should be noted that the position of the front panel 52 relative to the canister 48 is such that so long as the dust collector 47 is inserted within the collector chamber 16, the outer plane of the front panel 52 is situated flush with the outer plane of the side wall 10*d* of the housing structure 10 as clearly shown in FIG. 2. Within the space between the front wall 48*a* of the canister 48 and the front panel 52, a guide member 53 of a substantially elliptical shape in section as shown in FIG. 10, which may be integrally formed with the front panel 52 and which may also serves as a spacer means for holding the front wall and panel 48*a* and 52 in spaced relation to each other, is provided in position to communicate the circular opening 50 to the U-shaped opening 51 via the hollow of said guide member 53.

A suction socket 54 is rigidly mounted to the front wall 48*a* in alignment with the circular opening 50 and faces towards the tubular bracket 20 shown as supporting the inner terminal tubing 13*a*. This suction socket 54 is adapted to receive therein the free end extremity of the terminal tubing 13*a* and, although not shown, a gasket or a similar seal member is preferably lined or mounted in the inner cylindrical surface thereof to ensure a reliable and effective tight connection between the terminal tubing 13*a* and the suction socket 54.

A collector locking mechanism is also provided which will now be described with particular reference to FIGS. 1, 2, 3 and 10. The collector locking mechanism is housed within a portion of the space between the front wall and panel 48*a* and 52 and situated immediately below the guide member 53 and comprises a substantially L-shaped lever 55 having one end pivotally connected to the front wall 48*a* through a pin 56 and the other end serving as a manually operable handle 57 accessible through an access opening 52*a* which is formed in the front panel 52. The collector locking mechanism further comprises a locking rod 58 having one end pivotally connected by an elongated pin 59 and the other end adapted to be selectively engaged into and disengaged from a detent opening 60 formed in the bottom wall 10*c* of the housing structure. This locking rod 58 is normally downwardly biased by a spring member 61, which is a compression spring in the illustrated embodiment so that, when and so long as the collector 47 is inserted within the collector chamber 16, said other end of said locking rod 58 is engaged in the detent opening 60.

In order to remove out of the collector chamber the removable dust collector 47 that has been inserted within the collector chamber 16, what is required is to operate the handle 57 by hand in such a manner as illustrated in FIG. 3, i.e., to pull the handle 57 in a direction close to the front panel 52, thereby causing the lever 55 to pivot about the pin 56 in a direction such that the intermediate portion thereof is upwardly shifted. As the intermediate portion of said lever 55 is thus upwardly shifted, the locking rod 58 is accordingly upwardly shifted against the compression spring 61 with the lower end thereof clearing off from the detent opening 60 in readiness for the removal of the dust collector 47.

On the other hand, in the case where the collector 47 is to be housed within the collector chamber 16, what is required is to push the dust collector 47 in a direction towards the motor M and it will be readily seen that, upon completion of insertion of the dust collector 47 into the collector chamber, not only the outer end extremity of the terminal tubing 13*a* is automatically coupled to the suction socket 54 leading to the filter unit 49, but also the lower end of the locking rod 58 is engaged into the detent opening 60 by the action of the compression spring 61 to lock the dust collector 47 in position.

It is to be noted that, as best shown in FIG. 10, the L-shaped lever 55 and the access opening 52*a* are each so sized that three or four fingers except for the thumb can be inserted and accessible to the handle 57.

The filter unit 49 is removably inserted into the body of the canister 48 from the rear opening thereof and comprises outer and inner filter supports 62 and 63 having outwardly extending flanges formed therein as at 62*a* and 63*a*, respectively, and an elastic sealing frame 64. The elastic sealing frame 64 has an inner surface formed with a pair of spaced grooves into which one or both of the peripheral rims of the respective flanges 62*a* and 63*a* of the filter supports 62 and 63 are removably engaged while the inner filter supports 63 is accommodated within the outer filter support 62. This elastic sealing frame 64 acts not only to retain the outer and inner filter supports 62 and 63 in the manner as hereinabove described, but also to form a tight seal between the filter unit 49 and the partition wall 14 when the collector 47 is in position within the collector chamber 16. It is to be noted that as clearly shown in FIGS. 2 and 3, the partition wall 14 dividing the lower compartment of the housing structure 10 into the motor chamber 15 and the collector chamber 16 is formed with a suction opening 14*a* situated in front of the motor M. The filter unit 49 is so sized that one end of the outer filter support 62, which is open and which is opposite to the flange 62*a*, can tightly contact against the front wall 48*a* of the canister 48 when said filter unit 49 is inserted into the canister 48. As best shown in FIG. 9, a pair of coarse filters 65 are stretched on both sides of the outer filter support 62. One end of the inner filter support 63 which faces towards the front wall 48*a* is closed and a pair of fine filters 66 each in a folded configuration are similarly stretched on both sides of the inner filter support 63 and faces towards the coarse filters 65.

In order to facilitate an accurate positioning of the filter unit 49 within the canister 48, a plurality of substantially triangular rib members, generally indicated by 67, are secured and arranged in position within the canister 48 so as to support the rear end of the filter unit 49 at a position adjacent the front wall 48*a*.

It will be seen that dust sucked into the vacuum hose 13 and subsequently guided into the canister 48 through the hollow of the guide member 53 is collected or filtered in two stages by the coarse and fine filters 65 and 66. In other words, a mass of relatively large particles forming the dust is collected by the coarse filter 65 and a mass of relatively fine particles which form the same dust and which have passed through the coarse filter 65 can be collected by the fine filter 66.

In order to remove the dust collected within the canister 48 by the filter unit 49, after the dust collector 47 has been removed out of the collector chamber 16 in the manner as hereinbefore described, the filter unit 49 should be removed out of the canister 48. Fine particles of dust which have passed through the coarse filter 65, but collected or trapped by the fine filter 66, can be removed through the opening of the outer filter support 62 adjacent the wall 48*a*, when the filter unit 49 is removed out of the canister 48. In other words, coarse and fine particles of dust are, when the filter unit 49 is thus removed out of the canister 48, left within the canister 48, without requiring the inner filter support 63 to be separated from the outer filter support 62. The dusts within the canister 48 can be transported to a suitable waste disposal container or area. Cleaning of the fine filter 66 may or need not be carried out so often as to the coarse filter 65.

The motor M forming the source of vacuum is supported in any known manner within the motor chamber 15, for example, by means of a perforated elastic packing 69 and an elastic seat 70, both being made of a synthetic material having a relatively low elasticity. Alternatively, the motor M may be supported within the chamber 15 by the use of a rigid framework or may be directly mounted to a wall of the housing structure 10. However, these alternative methods of motor mounting cannot be recommended because vibrations generated by the motor M during the operation thereof will be unfavorably transmitted to the housing structure 10. In addition thereto, if desired, a space within the motor chamber 15 and around the motor M may be filled with a vibration absorbing material such as glass wool or similar material.

The motor M should be understood as having a built-in suction fan (not shown) which creates a flow of air in a direction from the vacuum hose 13 towards the filter unit 49. In order to achieve this flow of air, the air created by the suction fan should be blown off or exhausted to the atmosphere in a direction opposite to the above described flow of air. For this purpose, a blow-off port 71 may be formed in one of the front and rear walls 10*a* and 10*b*, for example, in the front wall 10*a* as shown. The mere provision of the blow-off port 71 in the front wall 10*a* is in some case unfavorable in view of the fact that an exhaust of air emerging from this port 71 is objectionable. In order to avoid this, according to the present invention, means substantially functioning as a muffler is provided which will not be described with particular reference to FIGS. 1, 11 and 12.

A decorative front panel 72 of a height greater than the front wall 10*a* of the housing structure 10 is attached to the outer surface of the front wall 10*a* by means of a spacer framework of a construction which will subsequently be described. The spacer framework as best shown in FIG. 12 includes a pair of pillars 73*a* and 73*b* and a pair of beams 74*a* and 74*b* assembled in a contour substantially similar to the configuration of the front panel 72. These pillars 73*a* and 73*b* and beams 74*a* and 74*b* are of the same thickness. A reinforcement pillar 75 and a reinforcement beam 76 crossing said reinforcement pillar 75 in the same plane at right angles thereto are respectively secured in position between the beams 74*a* and 74*b* and between the pillars 73*a* and 73*b*. While the thickness of the reinforcement pillar 75 is equal to that of any of the pillars 73*a* and 73*b* and beams 74*a* and 74*b*, the thickness of the reinforcement beam 76 is smaller than said pillar 75. At a corner of the spacer framework which is defined by the pillar 73*b* and the beam 74*b*, a substantially L-shaped convering is provided which may register with the blow-off port 71 in the front wall 10*a* when said spacer framework is held in position between the front wall 10*a* and the front panel 72. The blow-off port 71 may not be always necessary and, if it is not employed, the covering 77 may be omitted accordingly. However, by the reason as will become clear from the latter description, the blow-off port 71 is provided and is adapted to be normally closed by a lid 78 which is pivotally mounted to the inner surface of the front wall 10*a* at a position immediately above the blow-off port 71 and is gravity-biased so as to close said blow-off port 71.

Within the motor chamber 15, a wall member 79 having a through hole 79*a* is stretched between the partition plate 11 and the bottom wall 10*c* with said through hole 79*a* in alignment with the blow-off port 71. Air blown by the suction fan driven by the motor M flows through the hole 79*a* into a space between said wall member 79 and the front wall 10*a* and then flows into the space between the front wall 10*a* and the front panel 72 through a plurality of perforations 80 formed in the front wall 10*a*, in such a manner as substantially indcated by the arrowheaded lines.

The wall member 79 having the through hole 79*a* may be omitted where the blow-off port 71 is not employed.

The air emerging from the perforation 80 is upwardly guided, passing through a narrow area defined between the front wall 10*a* and one half of the reinforcement beam 76 due to the difference in thickness between the reinforcement beam 76 and any of the pillars 73*a* and 73*b* and 75, and finally discharged to the atmosphere through the recess 74*c*. It is to be noted that during travel of the air from the motor chamber 15 to the atmosphere in the manner as hereinbefore described, the flow rate thereof is first retarded by the perforations 80 and then by the narrow area between the front wall 10*a* and that portion of the reinforcement beam 76 so that a noisy sound accompanied by the flow of the air to be discharged can be effectively reduced.

When to place the spacer framework in position between the front wall 10*a* and the front panel 72, there may be a clearance between the front panel 72 and the reinforcement beam 76 because of the difference in thickness between the beam 76 and any of the other components 73*a*, 73*b*, 74*a*, 74*b* and 75 of the spacer framework. To avoid the formation of this crearance, the front wall 10*a* is formed with a plurality of pressure-molded projections 81 each being in a size sufficient to compensate for the above described difference in thickness, and through which projections 81 set screws 82 are tapped into the reinforcement beam 76.

It has now become clear that the front panel 72 not only serves to give a comfortable appearance to look at, but also forms a part of the muffler to reduce the noise.

It is well known that most present-day vacuum cleaners can also be used as a blower utilizing the exhaust air. The vacuum cleaner of the present invention can also be used as a blower and, for this purpose, in addition to the through hole 79*a* and the blow-off port 71, a blow-off socket 72*a* is formed in the front panel 72 in alignment with said hole 79*a* and port 71 for receiving a blower hose 82 in such a manner as indicated by the imaginary line in FIG. 11. The blower hose 82 may be either the vacuum hose 13 itself or a flexible hose separate of the vacuum hose. As clearly shown in FIG. 11, these openings 79*a*, 71 and 72*a* are so sized relative to the blower hose 82 that one of both ends of said blower hose 82, which is to be coupled to the vacuum cleaner in the manner as shown in FIG. 11, can extend through these openings and terminate adjacent the motor thereby permitting the exhaust air to travel through the blower hose 82 in a whole amount.

If the blower hose 82 is removed from the vacuum cleaner, the exhaust air travels in the manner as hereinbefore described and in the manner as indicated by the arrow-headed lines in FIG. 11. The exhaust air emerging through the perforation is not be discharged through the blow-off socket 72*a* because of the covering 77 in the spacer framework.

Referring back to FIGS. 1 and 2, the space 17 defined by the walls 10*a*, 10*b*, 10*c* and 10*d* and the top lid 26 in the closed position is adapted to be closed by a side lid 83 hinged as at 84 to one side edge of the rear wall 10*b*. Some appurtenances such as floor brush 85, extensible wand 86, nozzle 87 and cloth cleaning brush 88 are accommodated within this space 17 together with the outer terminal tubing 13*b* and, for this purpose, a series of clips, generally indicated by 89, for holding the respective appurtenances are secured to the inner surface of the side lid 83.

The side lid 83 can be manually selectively opened and closed and when closed, it can be locked in the closed position by the magnetic attraction between a metal piece 90*a* secured to the inner surface of the side lid 83 and a magnet 90*b* secured to either a corresponding side edge of the front wall 10*a* or a corresponding side edge of the front panel 72.

In case where a gap or clearance is formed between the top lid 26 and the side lid 83 when they are respectively closed, a rigid or elastic shade member may be provided, for example, secured to the top lid 26 as at 91 thereby to cover such gap or clearance.

Assuming that the top and side lids 26 and 83 are closed with the vacuum hose 13 accommodated within the hose chamber 12 in the manner as shown in FIG. 2, what is required to do when the vacuum cleaner is to be used is to open these lids 26 and 83 and then to remove a desired length of the vacuum hose 13 out of the hose chamber 12. After one of the appurtenances removed from the clip 89 has been coupled to the outer terminal tubing 13*a*, switching on of either the switch 44 or the switch 45 causes the vacuum cleaner to start its operation.

After the cleaning job has completed, the top lid 26 if not closed at the time of start of the cleaning job should be closed and then the switch 43 should be turned on to operate the motor 29. It will be readily seen that the vacuum hose 13 can be automatically drawn back into the hose chamber 12. At the time the vacuum hose 13 has been sufficiently accommodated within the hose chamber 12, the switch 43 should be turned off and the outer terminal tubing 13*b* be secured to the clip 23. A certain length of the vacuum hose 13 may be left undrawn, in which case it may be hung in such a manner as indicated by the imaginary line in FIG. 1.

It is to be noted that the U-shaped opening 18 in the side wall 10*d* may be provided with a correspondingly shaped covering 92 made of a material having a relatively low frictional coefficient. Although not shown, the vacuum cleaner according to the present invention may be provided with at least four casters which may be secured to the outer surface of the bottom plate 10*c*, to facilitate transportation of the vacuum cleaner from room to room.

Referring now to FIGS. 13 and 14, it will be readily seen that the vacuum cleaner according to a second preferred embodiment is simpler in construction than that according to the foregoing embodiment. The housing structure 10 comprises front, rear, bottom and opposed side walls 10*a*′, 10*b*′, 10*c*′, 10*d*′ and 10*e*′. The front and rear walls 10*a*′ and 10*b*′ are of different height and, similarly, the side walls 10*d*′ and 10*e*′ are of different height. The side wall 10*d*′ is rigidly sandwiched between respective side edges of the front and rear wall 10*a*′ and 10*b*′ with both ends thereof spaced from the bottom wall 10*c*′ and the plane lying on the top edges of the front and rear walls 10*a*′ and 10*b*′, thereby providing respective openings 100 and 101 which correspond in function to the openings 19 and 18 of the foregoing embodiment.

The rear wall 10*b*′ has one corner portion adjacent the opening 101 integrally formed with an extension wall 10*b*″ which outwardly projects from the plane of the side wall 10*d*′.

The housing structure 10 includes a top lid 26′ hinged as at 27 to the rear wall 10*b*′ for selective opening and closing the top opening of the housing structure, which top lid 26 has a flanged wall 26′*a* which may be integrally formed therewith and which is of a size sufficient to cover a clearance formed between the top edge of the front wall 10*a*′ and the plane of the top lid 26′ when the latter is closed. The clips 80 for holding the appurtenances such as floor brush 85, extensible wand 86 and nozzle 87, which have been described as secured to the inner surface of the side lid 83 in the foregoing embodiment, are secured to the inner surface of the top lid 26′.

As best shown in FIG. 14, a covering plate 103 rigidly secured to the extension wall 10*b*″ extends at right angles to the plane of the rear wall 10*b*′ and in parallel relation to the plane of the side wall 10*d*′ and is held in position to hide the opening 101 and also to define an entrance 104 in cooperation with an upper portion of the side wall 10*d*′, which entrance 104 faces downwardly.

A guide roll 105 suspended from the inner surface of the top lid 26′ in a similar manner as the driven roll 24 is positioned within a space defined by the extension wall 10*b*″, the covering plate 103, and a portion of the flanged wall 26′*a* and above the entrance 104 for forcibly guiding the vacuum hose 13 so as to deflect without making the hose 13 to contact the covering wall 103. The extension wall 103 and the side wall 10*d*′ are respectively mounted with elastic, cushioning pads 106*a* and 106*b* situated adjacent the entrance 104, each of said pads 106*a* and 106*b* being of a substantially semicircular shape in section.

The motor 29 employed in this embodiment of FIGS. 13 and 14 requires a separate reduction gear unit 29*a* for transmitting a rotational force of the motor 29 to the drive roll 28.

The dust collector 47 comprises a removable canister 48′ having the top wall formed with a suction socket 54′ for receiving the inner terminal tubing 13*a* of the vacuum hose 13. It should be noted that the top wall of the canister 48′ cooperates with a partition plate 11′ to provide the bottom of the hose chamber 12.

The filter unit 49 employed in this embodiment of FIGS. 13 and 14 comprises a substantially conically shaped, apertured cover 107 having a cornered flange 107*a* on which an elastic sealing frame 64′ is mounted. The filter unit 49 further comprises a filter bag 108 covering said apertured cover 107, the cornered edge at the opening of which filter bag 108 is embedded in the elastic sealing frame 64′. The filter unit 49 in this embodiment of FIGS. 13 and 14 can be removed from the canister 48′ in a similar way as the filter unit 49 of the foregoing embodiment, but prior to removal of the filter unit 49 from the canister 48′, the inner terminal tubing 13*a* of the vacuum hose 13 should be disengaged from the suction socket 54′ and the canister 48′ should subsequently be removed out of the housing structure 10.

For discharging air created by the fan of the motor M to the atmosphere, an opening is formed as at 109 in the bottom wall 10*c*′. However, to render the vacuum cleaner according to the embodiment of FIGS. 13 and 14 to be useable as a blower, the opening 109 may be formed in any of the front, rear and side walls 10*a*′, 10*b*′ and 10*e*′ in the form of a blow-off socket capable of receiving a blower hose which may be the vacuum hose 13 itself.

The vacuum cleaner according to the second preferred embodiment of the present invention can be operated in a similar manner as that according to the foregoing embodiment. However, when the removable canister 48′ is to be removed, disconnection between the inner terminal tubing 13*a* and the suction socket 54′ should be made and this is a somewhat complicated procedure as compared with the vacuum cleaner of the foregoing embodiment.

In a third perferred embodiment of the present invention which is shown in FIGS. 15 to 17, a top lid 26″ is hinged to the top edge of the side wall 10*e* by means of a hinge 27′. In addition, the side lid 83 is provided with a recess 83*a* to provide for the convenient storage of the appurtenances by means of the clips 80. Except for the foregoing details, a major portion of the housing structure 10 and an operating portion of the vacuum cleaner are respectively similar to that according to the first embodiment and that according to the second embodiment and, therefore, description of which is herein omitted for the sake of brevity.

It is, however, to be noted that reference numeral 109 represents a switch lever operatively coupled to a switch (not shown) for selectively energizing and deenergizing the motor 29.

Although the present invention has been fully described by way of the preferred embodiments thereof, it should be noted that various changes and modifications are apparent to those skilled in the art. By way of example, if desired, decorative panels may, in addition to the front panel attached to the outer surface of the front wall of the housing structure, be attached to some or all of the outer surfaces of the rear and side walls, of the top lid and of the side lide. Alternatively, the housing structure including the top lid and the side lid may be built up by wooden material having one surface bearing a certain decorative design.

Therefore, unless such changes and modifications depart from the true scope of the present invention, they should be construed as included therein.

What is claimed is:

1. A vacuum cleaner which comprises:

a housing structure including front, rear and side walls;

a source of vacuum stationarily housed within said housing structure, thereby occupying a first area of the interior of said housing structure;

a removable dust collector removably accommodated within said housing structure, thereby occupying a second area of the interior of said housing structure adjacent said first area thereof, said collector being, when held in position within said second area, operatively coupled to said vacuum source;

a flexible vacuum hose having an inner end removably coupled to said dust collector and an outer end situated outside said housing structure, a substantially intermediate portion of which flexible vacuum hose is adapted to be accommodated within said housing structure thereby occupying a third area of the interior of said housing structure immediately above said first and second areas;

an opening formed in one of said side walls of said housing structure and through which said flexible hose loosely extends;

an automatic drawing mechanism for drawing back into said third area, a length of said flexible hose that has been extended outside said third area and out of said housing structure for use, said automatic drawing mechanism including a pair of rolls parallely spaced a distance slightly smaller than the outer diameter of the flexible hose, said flexible hose being operatively sandwiched between said rolls, and a drive unit for driving at least one of said rolls for automatically drawing said flexible hose back into said third area in cooperation with the other roll when said drive unit is operated; and a hingedly supported top lid for selectively opening and closing an opening at the top of said housing structure, said opening in said side wall opening at the opening at the top of said housing structure thereby to facilitate takeout of said flexible hose from said third area in readiness for a cleaning job, said other roll being rotatably mounted to said top lid in such a manner as to face towards said one of said rolls.

2. A vacuum cleaner as claimed in claim 1, wherein said top lid has an inner surface facing said third area and mounted with a plurality of holders for removably holding a necessary number of appurtenances selectively utilizable by coupling to the outer end of the flexible hose during a cleaning job.

3. A vacuum cleaner as claimed in claim 1, wherein said one of the side walls which is formed with said opening through which said flexible hose loosely extends is also formed with an entrance below said opening in said side wall, said dust collector being removably inserted into said second area through said entrance.

4. A vacuum cleaner as claimed in claim 3, wherein said housing structure further includes a side lid hingedly supported for selectively covering and uncovering said one of the side walls.

5. A vacuum cleaner as claimed in claim 4, wherein said side lid has an inner surface facing said one of said side walls and mounted with a plurality of holders for removably holding a necessary number of appurtenances selectively utilizable by coupling to the outer end of the flexible hose during a cleaning job.

6. A vacuum cleaner as claimed in claim 1, further comprising passage means, within said housing between said second and third areas thereof, disposed between said inner end of said flexible hose and said collector for facilitating an automatic connection between said flexible hose and said collector when said dust collector is inserted into said second area.

7. A vacuum cleaner as claimed in claim 6, wherein said dust collector further includes a manually releasable locking mechanism for locking said collector in position within said second area.

8. A vacuum cleaner as claimed in claim 7, wherein said manually releasable locking mechanism comprises a manually operable lever supported by said collector for pivotal movement between a locked position and a released position, means for biasing said manually operable lever to said locked position and a locking rod coupled to said manually operable lever, a free end of said locking rod being engaged to a portion of said housing structure when said manually operable lever is in said locked position and disengaged therefrom when said manually operable lever is manually shifted to said released position against said biasing means.

9. A vacuum cleaner as claimed in claim 6, wherein said first and second areas and said third area are divided by a partition wall held in position within said housing structure and providing the bottom for said first area, and wherein said passage means includes a tubular bracket rigidly mounted on said partition wall and a ring-shaped mount rigidly mounted on said partition wall, said inner end of said flexible hose beng removably coupled to said passage means through said mount and said bracket.

10. A vacuum cleaner as claimed in claim 1, wherein said one roll is operatively supported by a rigid framework within said housing between the front and rear walls of said housing structure, and said other roll is positioned between said front and rear walls of said housing when said top lid is closed.

11. A vacuum cleaner as claimed in claim 1, wherein said one of said rolls is a drive roll which is operatively supported by a rigid framework within said housing between the front and rear walls of said housing structure, said rigid framework comprising a rigid base, which may form a part of a casing for said drive unit and which is rigidly secured to one of said front and rear walls, a bearing plate rigidly secured to the other of said front and rear walls, and a plurality of spacer beams parallely held in position between said base and said bearing plate, said drive roll having a pair of opposed shaft members, one of which shaft members is journalled to said bearing plate and the other shaft member is operatively coupled to said drive unit.

12. A vacuum cleaner as claimed in claim 11, wherein said housing structure further includes a locking mechanism operatively associated with one of opposed shaft members of said other roll for locking said top lid in a closed position.

13. A vacuum cleaner as claimed in claim 1, wherein said one of said rolls comprises a hollow cylindrical body made of a rigid material, and an elastic lining layer applied on the whole outer peripheral surface of said cylindrical body, said elastic lining layer having an outer peripheral surface formed with a plurality of equally spaced and axially extending grooves, a spacing between the adjacent grooves of each pair being substantially equal to the span between the adjacent pair of convolutions of the spiral rib of the flexible hose of a spirally ribbed design, so that the vacuum hose and said one of said rolls can, during a drawing operation, engage to each other in a similar fashion to a gear-to-gear engagement.

14. A vacuum cleaner as claimed in claim 1, wherein portions of the inner surfaces of said housing structure which define said third area are applied with a layer of material having a relatively low frictional coefficient to facilitate slippage between them and portions of the flexible vacuum hose when the latter contact thereto.

15. A vacuum cleaner as claimed in claim 1, wherein the outer surface of said one of said side walls is provided with a holder for holding the outer end of said flexible hose, said holder being situated substantially below said opening formed in said one of said side walls.

16. A vacuum cleaner as claimed in claim 1, wherein said housing structure further includes at least one decorative panel secured to the front of said housing structure in spaced relation thereto, and passage means in said housing between the vacuum source and a space between the front and said panel, the space between said front and said panel being utilized as exhaust passage means for exhausting air created by said vacuum source to the outside of said housing structure.

17. A vacuum cleaner as claimed in claim 16, wherein a spacer framework is provided between said front of said housing structure and said decorative panel, said spacer framework having a portion which, when said spacer framework is held in position between the front of the housing structure and the decorative panel, defines an orifice means in cooperation with said front of said housing structure, said orifice means constituting a part of said passage means.

* * * * *

UNITED STATES PATENT OFFICE

CERTIFICATE OF CORRECTION

Patent No. 3,977,037 Dated August 31, 1976

Inventor(s) Yuji Miyake et al.

It is certified that error appears in the above-identified patent and that said Letters Patent are hereby corrected as shown below:

Column 16, line 28, before "area" change "first" to -- third --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*